US008132749B2

(12) United States Patent
Noge et al.

(10) Patent No.: US 8,132,749 B2
(45) Date of Patent: Mar. 13, 2012

(54) ELECTROPHOTOGRAPHIC TONER PULVERIZING APPARATUS AND ELECTROPHOTOGRAPHIC TONER PULVERIZING METHOD

(75) Inventors: Kouji Noge, Numazu (JP); Nobuyasu Makino, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 903 days.

(21) Appl. No.: 12/092,519

(22) PCT Filed: Aug. 20, 2007

(86) PCT No.: PCT/JP2007/066501

§ 371 (c)(1),
(2), (4) Date: May 2, 2008

(87) PCT Pub. No.: WO2008/032547

PCT Pub. Date: Mar. 20, 2008

(65) Prior Publication Data

US 2008/0227022 A1 Sep. 18, 2008

(30) Foreign Application Priority Data

Sep. 15, 2006 (JP) ..... 2006-250575
Aug. 8, 2007 (JP) ..... 2007-206217

(51) Int. Cl.
*B02C 25/00* (2006.01)

(52) U.S. Cl. ..... 241/30; 241/260

(58) Field of Classification Search ..... 241/30, 241/260

See application file for complete search history.

(56) References Cited

U.S. PATENT DOCUMENTS 5,171,138 A * 12/1992 Forrest ..... 418/48
6,336,796 B1 * 1/2002 Cholet et al. ..... 418/48

FOREIGN PATENT DOCUMENTS

| | | |
|---|---|---|
| CN | 1165201 A | 11/1997 |
| JP | 61 127893 | 6/1986 |
| JP | 64 53735 | 3/1989 |
| JP | 2 61019 | 3/1990 |
| JP | 2003 173046 | 6/2003 |
| JP | 2005 177579 | 7/2005 |
| JP | 2005 195762 | 7/2005 |

* cited by examiner

*Primary Examiner* — Bena Miller
(74) *Attorney, Agent, or Firm* — Oblon, Spivak, McClelland, Maier & Neustadt, L.L.P.

(57) ABSTRACT

To provide an electrophotographic toner pulverizing apparatus and an electrophotographic toner pulverizing method for preventing reduction in wear resistance of a rotor, a stator, and the like even in long-term pulverizing of toner. The electrophotographic toner pulverizing apparatus according to the present invention has a pulverizing chamber with at least a rotor and a stator disposed therein. The surface of at least one of the rotor and the stator has a chromium plated layer having Cr as a main component and containing Mg, Al, Si, Ti, Mn, Fe, and C elements.

7 Claims, 3 Drawing Sheets

ELECTROPHOTOGRAPHIC TONER PULVERIZING APPARATUS AND ELECTROPHOTOGRAPHIC TONER PULVERIZING METHOD

TECHNICAL FIELD

The present invention relates to an electrophotographic toner pulverizing apparatus and an electrophotographic toner pulverizing method for pulverizing a toner formed from a binding resin, a colorant and the like, and used for image formation by an electrophotographic method.

BACKGROUND ART

In image forming methods such as an electrophotographic method, an electrostatic photographic method, and electrostatic printing method, toners are used to develop latent electrostatic images.

A toner or a colored resin powder for developing latent electrostatic images in electrophotography and the like is formed at least from a binding resin and a colorant. Usually, the toner or colored resin powder is prepared by melt kneading a mixture having at least the aforementioned materials in a kneading apparatus, cooling and solidifying, and then pulverizing and classifying the solidified material to adjust it to a predetermined particle size.

Presently various property values of toners or colored resin powders, after their particle size has been adjusted to a predetermined level, are improved by adding various additive(s), e.g., with the object of improving flowability index.

Customers require image forming systems that can provide high-sensitivity and high-quality images, and toners are accordingly required to have decreased softening point and reduced particle size.

Further, mechanical pulverizing apparatuses such as shown in FIG. 4 have been mainly used in recent years because they discharge less carbon dioxide than conventional airflow pulverizers and place a small load on environment.

However, the problems associated with such apparatuses include wear of rotor or stator and reduced production capacity caused by contact with the material to be pulverized during pulverizing.

Patent Literature 1 describes a mechanical pulverizing apparatus containing a rotor and a stator that is held at a fixed distance from the rotor surface and disposed around the rotor, where a constant gap between the rotor and stator forms an annular space, this apparatus having a surface treated layer at least on either the rotor surface or the stator surface, this surface treated layer being obtained by plating with a chromium alloy having chromium carbide. The problem associated with such mechanical pulverizing apparatus is that microcracks appear in a long-term use making it impossible to use the apparatus.

Patent Literature 2 describes a toner manufacturing method by which material to be pulverized that has a large particle diameter and has a coarse pulverized product that has been recycled is introduced for pulverizing into a mechanical pulverizing apparatus having a rotor and a stator that is held at a fixed distance from the rotor surface and disposed around the rotor, coarse particles and overpulverized particles are removed by classification from the pulverized material, and the remaining pulverized material with a predetermined particle diameter is introduced into a surface modification apparatus using mechanical impact force for surface modification, wherein a surface of an impact force imparting member of the surface modification apparatus has a chromium plated layer having chromium carbide. However, because the chromium plated layer is not an alloy containing Cr as the main component and having other elements such as Mg, Al, Si, Ti, Mn, Fe, and C, wear resistance thereof is not always sufficient.

The inventors have earlier suggested (in particular, see Patent Literature 3) providing a coating for improving wear resistance on the surface of an impeller constituting a classification rotor of the toner manufacturing apparatus, but this toner manufacturing apparatus is a fluidized bed pulverizing apparatus rather than a mechanical pulverizing apparatus. Further, the coating designed to improve wear resistance is Nickel Teflon (trade name) and is not an alloy containing Cr as the main component and having other elements such as Mg, Al, Si, Ti, Mn, Fe, and C.

As shown in FIG. 1, the plated layer starts peeling from the crack initiation locations.

Wear generated in the case illustrated by FIG. 1 is apparently chipping wear.

Further, because metal particles are larger than toner particles, the metal particles cause cracking when they penetrate into joint portions, thereby easily inducing chipping wear.

To repair the structure, an extremely complex process has to be used in which the original coating film is stripped completely and the entire surface is cleaned and recoated.

[Patent Literature 1] Japanese Patent Application Laid-open (JP-A) No. 2003-173046

[Patent Literature 2] Japanese Patent Application Laid-open (JP-A) No. 2005-195762

[Patent Literature 3] Japanese Patent Application Laid-open (JP-A) No. 2005-177579

DISCLOSURE OF INVENTION

It is an object of the present invention to provide an electrophotographic toner pulverizing apparatus and an electrophotographic toner pulverizing method that prevent wear resistance of rotor, stator, and the like from reducing even in long-term pulverizing of toner.

The following means are provided for resolving the aforementioned problems.

<1> An electrophotographic toner pulverizing apparatus, having a pulverizing chamber having at least a rotor and a stator disposed therein, wherein a surface of at least one of the rotor and the stator has a chromium plated layer having Cr as a main component and containing Mg, Al, Si, Ti, Mn, Fe, and C elements.

<2> The electrophotographic toner pulverizing apparatus according to <1>, wherein the surface of the chromium plated layer is subjected to a treatment against hydrogen embrittlement.

<3> The electrophotographic toner pulverizing apparatus according to one of <1> or <2>, wherein the chromium plated layer has two or more layers.

<4> The electrophotographic toner pulverizing apparatus according to <3>, wherein a thickness of a first layer positioned on a side of the surface of at least one of the rotor and the stator in the chromium plated layer is 10 μm to 50 μm.

<5> The electrophotographic toner pulverizing apparatus according to one of <3> and <4>, wherein a total thickness of a second layer and subsequent layers is 40 μm to 100 μm, when a layer positioned on the side of the surface of at least one of the rotor and the stator in the chromium plated layer is taken as the first layer.

<6> The electrophotographic toner pulverizing apparatus according to any one of <3> to <5>, wherein an adhesive force between the first layer positioned on the surface of at least one of the rotor and the stator in the chromium plated layer and a plating object is 0.5 t/cm$^2$ to 2.5 t/cm$^2$.

<7> The electrophotographic toner pulverizing apparatus according to any one of <3> to <6>, wherein an adhesive force between the second layer and subsequent layers, and a plating object is 0.5 t/cm$^2$ to 2.5 t/cm$^2$, when a layer positioned on the surface of at least one of the rotor and the stator in the chromium plated layer is taken as the first layer.

<8> The electrophotographic toner pulverizing apparatus according to any one of <1> to <7>, wherein a surface hardness of an outermost surface in the chromium plated layer is HV800 to HV1,400, as a Vickers hardness.

<9> An electrophotographic toner pulverizing method including: pulverizing toner by use of the electrophotographic toner pulverizing apparatus according to any one of <1> to <8>.

The present invention makes it possible to resolve the above-described problems inherent to the related art and can provide an electrophotographic toner pulverizing apparatus and an electrophotographic toner pulverizing method preventing wear resistance of rotor, stator, and the like from reducing even in long-term pulverizing of toner.

BEST MODE FOR CARRYING OUT THE INVENTION

The present invention will be described below in greater detail.

Figure 5A:
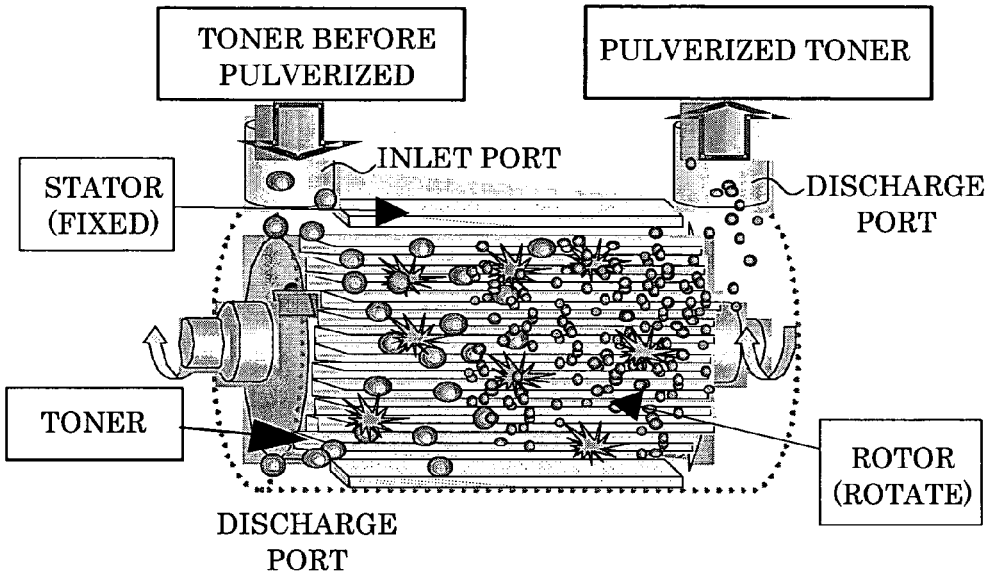
FIG. 5A is a schematic view illustrating the structure of the mechanical pulverizing apparatus in accordance with the present invention.
Figure 5B:
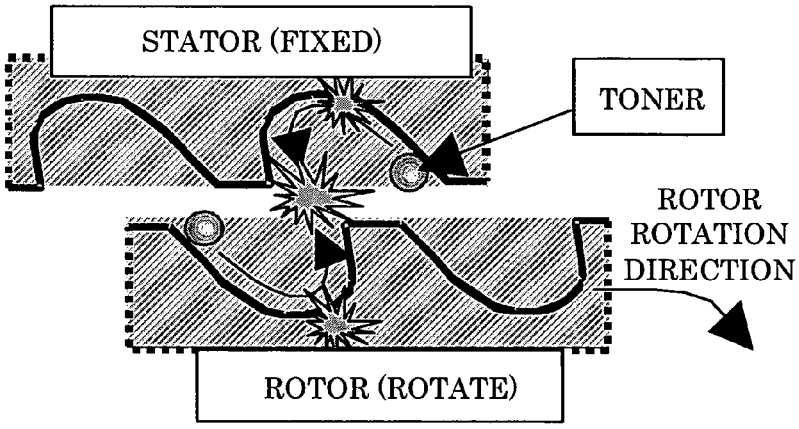
FIG. 5B is a schematic cross-sectional view of FIG. 5A.

FIG. 5A shows the structure of the mechanical pulverizing apparatus in accordance with the present invention containing a rotor and a stator that is held at a fixed distance from the rotor surface and disposed around the rotor, where a constant gap between the rotor and stator forms an annular space. FIG. 5B is a schematic cross-sectional view of the mechanical pulverizing apparatus shown in FIG. 5A.

In the mechanical pulverizing apparatus, a toner is pulverized by collisions with the stator and rotor or by repeated collisions of toner particles with each other.

[Surface Treatment]

The chromium plated layer can be formed by surface treatment on at least one of the rotor and the stator.

The surface treatment performed in accordance with the present invention is a treatment of forming a chromium plated layer having Cr as a main component and containing Mg, Al, Si, Ti, Mn, Fe, and C elements on the surface of any one of the rotor and the stator.

As for the Mg, Al, Si, Ti, Mn, Fe, and C elements in the chromium plated layer, it is preferred that Mg be contained at 1% or less, Al at 1% or less, Si at 1% or less, Ti at 1% or less, Mn at 1% or less, Fe at about 4%, and C at about 2% to 3%. Examples of other components include 0 preferably at about 5%, S at about 1%, Co at about 8%, Ga at about 3%, Pd at about 3%, and Sb at about 3%.

Figure 1:
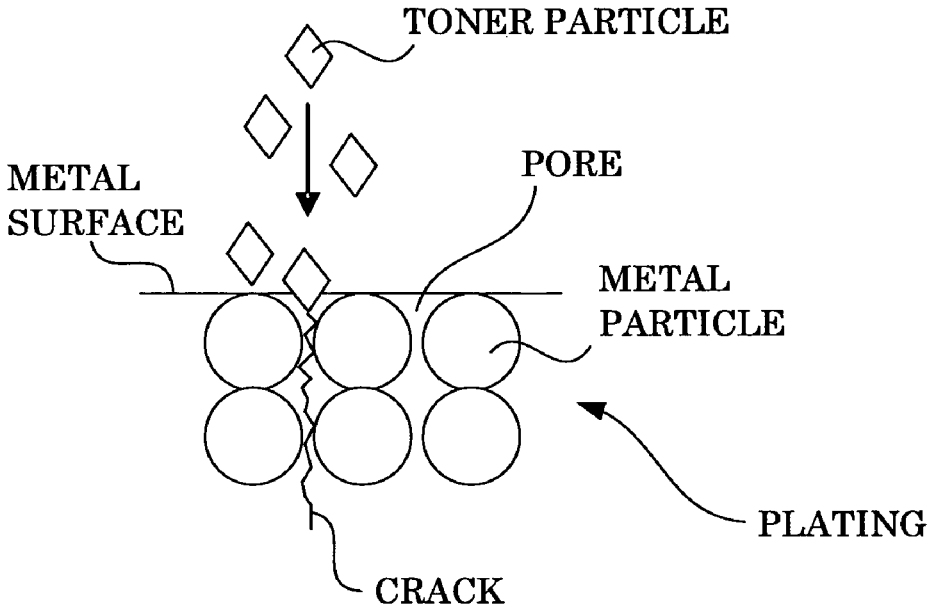
FIG. 1 is an explanatory drawing illustrating a mechanism of wear occurrence in the related art.
Figure 2:
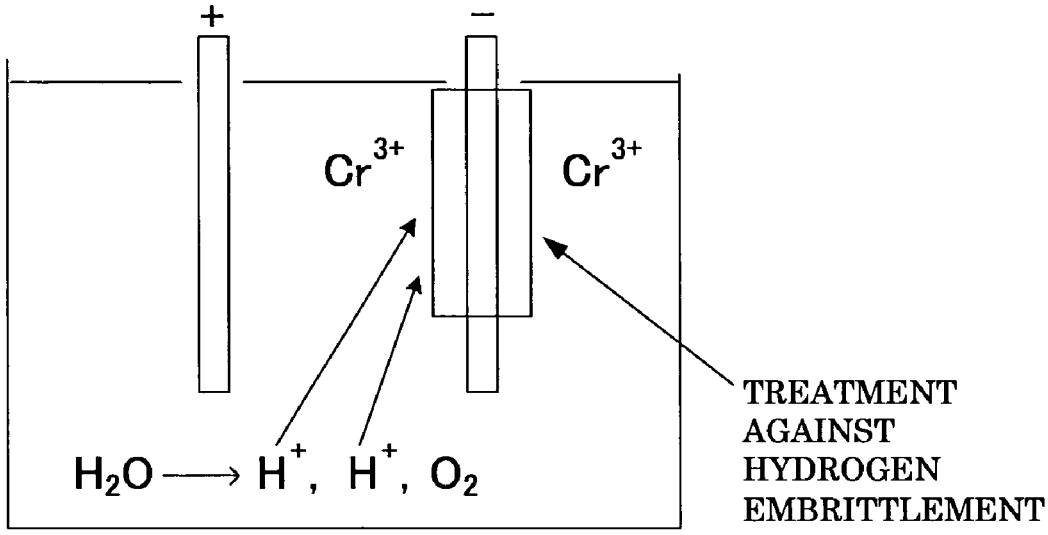
FIG. 2 is a schematic drawing illustrating treatment conducted against hydrogen embrittlement in accordance with the present invention.

Plating of the elements can be performed by element replacement, as shown in FIG. 2.

This method will be called below a special chromium carbide plating treatment or special carbide treatment (the below-described Example 3, etc.). The advantage of using this method is that strength is increased by comparison with the case where only the conventional chromium treatment (for example, Dichron plating developed by Chiyoda Daiichi Kogyo KK).

Further, as shown in FIG. 2, it is preferred that a treatment against hydrogen embrittlement be performed. The merit of such treatment is that cracks hardly occur in the surface of the pulverizing apparatus.

In electroplating, a hair cracking phenomenon easily occurs due to hydrogen embrittlement, but long-term durability can be ensured by filling the hair cracks. Thus, in HCr plating ($Cr^{3+}$+$H^+$), $H^+$ are attached to the surface in addition to $Cr^{3+}$, thereby causing hydrogen embrittlement, and when H comes off in the air, cracks (hair cracks) sometimes occur. In Dichron® plating ($Cr_{23}C_6$+Cr), a binder fills the caps appearing when H comes off.

Such hydrogen embrittlement easily occurs in high-carbon steels and ferrous metal workpieces that have been surface hardened by heat treatment or cold processing. In plating processes, hydrogen embrittlement often occurs in plating baths with hydrogen co-precipitation, such as pickling, cathode electrolytic washing, cathode electrolytic pickling, and alkaline galvanizing baths.

A method causing the absorbed hydrogen to desorb, for example, by heat treatment (for 3 h or more at 190° C. to 230° C.) can be used for preventing hydrogen embrittlement. In the present invention, such treatment is called a treatment against hydrogen embrittlement.

It is preferable that this treatment be conducted as early as possible within 1 h after the special chromium carbide plating treatment; proper treatment temperature and treatment time depend on the material thickness and shape.

The ISO International Standards specifies that heat treatment of ferrous metal parts having a maximum tensile strength of 1,050 MPa (107 kgf/mm$^2$) or more for 8 h to 24 h or more at 190° C. to 220° C. should be conducted as early as possible within 4 h after plating, and that parts subjected to surface hardening should be treated for 2 h or more at 130° C. to 150° C. (even at a higher temperature, provided that hardness does not decrease).

The chromium plated layer preferably has a layer configuration consisting of two or more layers that is obtained by applying two or more layers formed by the special chromium carbide plating treatment. In this case, strength of the chromium plated layer further increases.

Figure 3:
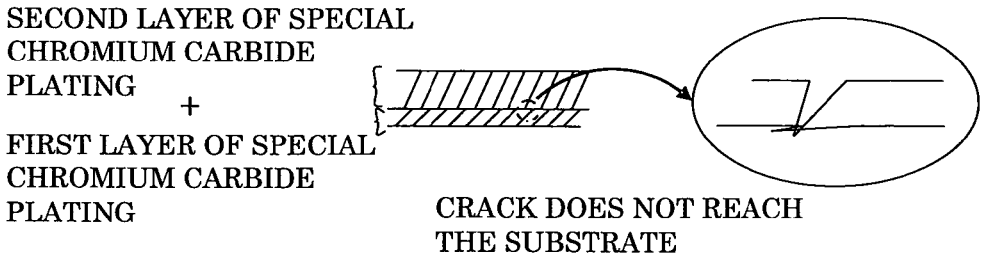
FIG. 3 illustrates the effect of two-layer coating by special chromium carbide plating in accordance with the present invention.
Figure 4:
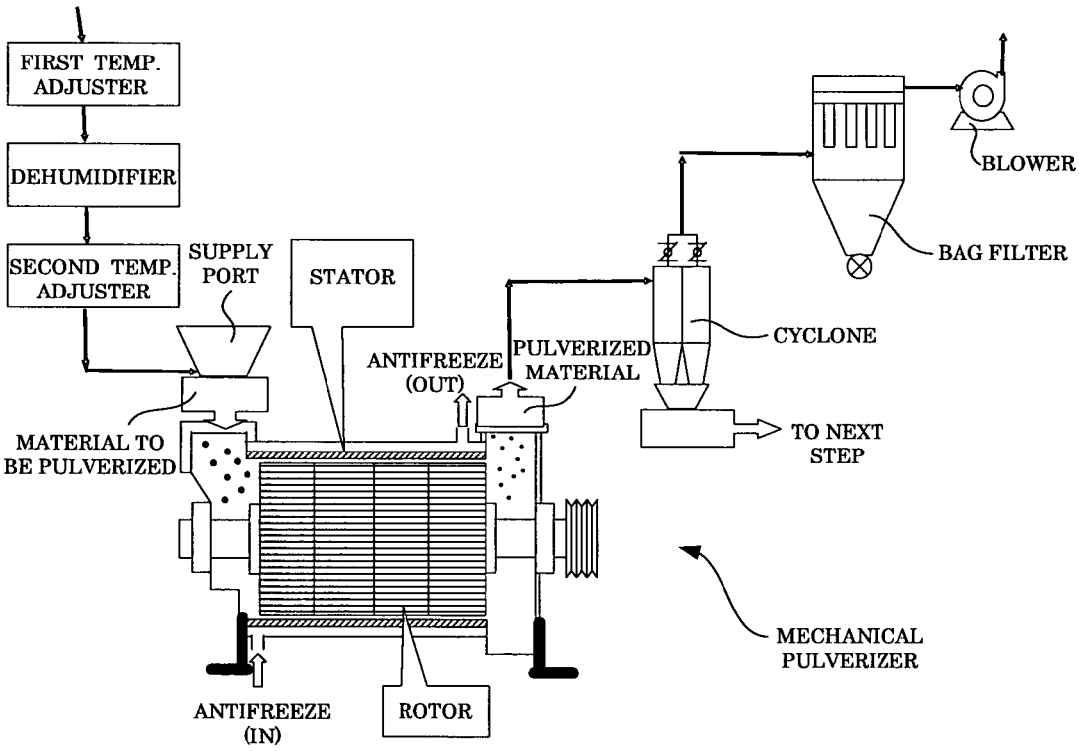
FIG. 4 is a schematic view of the conventional mechanical pulverizing apparatus.

With the two-layer configuration of the chromium plated layer, as shown in FIG. 3, even if a crack is initiated in the outermost surface layer of the chromium plated layer (second layer in FIG. 3), this crack does not reach the underlying layer (first layer in FIG. 3).

Where the thickness of the first layer in the chromium plated layer is too large, this layer easily peels off by itself.

Where two or more layers are coated, resistance of layers to peeling is increased, while the surface strength is maintained. In accordance with the present invention, for the sake of convenience, as shown in FIG. 3, the layers will be called a first layer and a second layer in the order of coating from the surface side (inner side) of the substrate (at least one of the rotor and the stator).

Plating of the second and subsequent layers will fail unless the heat treatment after plating the first layer and time that elapsed after this layer has been coated are adequately adjusted.

FIG. 3 illustrates the effect obtained in two-layer coating by the special chromium carbide plating in accordance with the present invention.

As shown in FIG. 3, even if a crack appears in the second layer, it remains in the second layer and does not reach the first layer.

Special chromium carbide plating is performed to obtain a metal layer containing Cr as the main component and having Mg, Al, Si, Ti, Mn, Fe, and C elements electrodeposited by an electrolytic metallurgy method on the metal surface, and after his layer has been fixedly attached, the special chromium carbide is then uniformly applied over the entire surface preferably two to four times, more preferably two to three times, and even more preferably two times. In these cases, cost efficiency and best quality for preventing microcracking (hair cracking) can be ensured.

In the first layer treatment of the surface treatment of the rotor and stator, the coating thickness of the first layer obtained by the special chromium carbide plating is preferably 10 μm to 50 μm, more preferably 20 μm to 40 μm, even more preferably 25 μm to 35 μm.

Where the coating thickness of the first layer is less than 10 μm, microcracks appear in the surface, wear then advances, and scratching or chipping sometimes occur.

Where the coating thickness of the first layer obtained by the special chromium carbide plating is more than 50 μm, the thickness of the plated layer is not uniform, and microcracks sometimes easily appear therein.

In the treatment of the second layer and subsequent layers after the first layer has been fixedly attached in the surface treatment of the rotor and the stator, the coating thickness obtained by the special chromium carbide plating is preferably 40 μm to 100 μm, more preferably 50 μm to 90 μm, and even more preferably 60 μm to 80 μm.

Where the coating thickness of the second layer and subsequent layers obtained by the special chromium carbide plating is less than 40 μm, the thickness variation of the first layer cannot be absorbed, microcracks appear in the surface, wear then advances, and scratching or chipping sometimes occurs.

Further, where the coating thickness of the second layer and subsequent layers obtained by the special chromium carbide plating is more than 100 μm, the coating thickness is not uniform and microcracks sometimes easily appear therein.

The thickness of the chromium plated layers in accordance with the present invention can be measured by cutting a sample with a diamond microtome, polishing the cut surface with a commercial $Al_2O_3$ abrasive powder, dyeing the polished surface with ruthenium oxide ($Ru_3O_4$), and performing observations by STM microphotography.

The adhesive force between the chromium plated layer formed on the surface of the rotor and the stator and a plating object is 0.5 t/cm$^2$ to 2.5 t/cm$^2$, more preferably 1.0 t/cm$^2$ to 2.0 t/cm$^2$, even more preferably 1.2 t/cm$^2$ to 1.8 t/cm$^2$. In these cases, cost efficiency and best quality for preventing microcracking can be ensured.

Where the adhesive force of the chromium plated layer is less than 0.5 t/cm$^2$, the plated layer is sometimes peeled off, surface wear then advances, and scratching or chipping sometimes occur.

Further, where the adhesive force of the chromium plated layer exceeds 2.5 t/cm$^2$, the coating thickness is not uniform and microcracks sometimes easily appear therein.

Here, the plating object means the rotor or the stator when the chromium plated layer is a single layer, but when two or more layers are formed, the plating object means a layer upon which the second and subsequent layers are formed in the chromium plated layer (for example, when the chromium plated layer has a two-layer structure, the plating object is the first layer).

A bending test (a method by which a sample is bent to a prescribed angle and then peeling state or hair cracking in the curve portion is examined). a tensile test (ISO6892; JIS Z2201 (JIS No. 5 specimen)), or the like can be used for measuring the adhesive force.

The adhesive force changes with temperature (aging temperature) and time (aging time).

[Surface Hardness Testing Method]

Surface hardness of the chromium plated layer can be represented by Vickers hardness. The Vickers hardness is obtained by using a diamond indenter in the form of a rectangular pyramid with an angle between opposing surfaces of 136°, producing a pyramidal indentation in a sample, and dividing the test force F (N) applied in this process by a surface area found from the length d (mm) of the indentation diagonal. The Vickers force is calculated by the following Equation (1).

[Vickers Hardness]

The Vickers hardness is one of measures representing hardness of industrial materials; it is an indentation hardness.

The test method was disclosed in 1925. An indenter having a pyramidal shape and produced from diamond in the form of a regular tetragonal pyramid with an angle between opposing surfaces of 136° is pressed into a material surface, the surface area is calculated from the length of diagonals of the indentation remaining after the load has been released, and the hardness is represented by a value obtained by dividing the test load F (kg) by the surface area d$^2$ (mm$^2$). The Vickers hardness is found by Equation (1).

A specific feature of the Vickers hardness is that it can be used for all metals, regardless of the material size, and this method is considered to have the highest utility among all the hardness test methods. This is because the shape of indentation is the same even if the load changes. As a result, hardness can be found by the same scale by merely changing the load for materials of different types and hardness of these materials can be compared.

In the Vickers hardness test, in a method by which a diamond indenter in the form of a rectangular pyramid is pressed into a material and hardness is calculated from the length of diagonal of the rectangular indentation produced in the sample surface, the load can be selected within a very wide range of from a very small load of 1 g or less to a large load of about 50 kg. Therefore, the method can be used within a wide range of materials from soft metals to quenched steel, superalloys, and ceramic materials. Further, in a cross section, e.g., of heat-treated gears, the quenching depth or the like can be also investigated by measuring Vickers hardness in different locations.

$$HV = 1.8909\ F/d^2 \qquad \text{Equation (1)}$$

EXAMPLES

Examples of the present invention will be described below, but shall not be construed as limiting the scope of the present invention. Note that "part(s)" means "parts(s) by mass" unless otherwise indicated.

[Pulverized Toner Material]

A mixture of the below-described composition was melted, kneaded and cooled and then coarsely pulverized to produce a coarsely pulverized material with an average particle diameter of about 400 μm.

Styrene-acryl copolymer (softening point: 120° C.) . . . 100 parts

Carbon black . . . 10 parts

Polypropylene (softening point: 125° C.) . . . 5 parts

Zinc salicylate . . . 2 parts

A mechanical pulverizing apparatus (Turbomill T250-RS type, product of Turbo Kogyo KK) was used as the mechanical pulverizing apparatus shown in FIGS. 5A and 5B, a rotor and a stator of this mechanical pulverizing apparatus were subjected to surface treatment under conditions indicated in Examples and Comparative Examples below, and then the coarsely group material was subjected to pulverizing with the apparatus. The surface state of the rotor and stator after the pulverizing was checked.

Example 1

A chromium plating treatment (special chromium carbide treatment) including Mg, Al, Si, Ti, Mn, Fe, and C elements was performed under the below-described plating conditions on the surface portions of the stator and rotor in the mechanical pulverizing apparatus shown in FIGS. 5A and 5B so as to obtain a thickness of the chromium plated layer of 40 μm.

[Plating Conditions]

Bath temperature: about 60° C.; pH: strongly acidic (pH 4 or less); electric current: depends on volume, weight, and surface area; voltage; depends on volume, weight, and surface area; time depends on volume, weight, and surface area; stirring: no stirring.

Example 2

Under plating conditions similar to those used in Example 1, a chromium plated layer of 10 μm thickness (first layer) was deposited, followed by deposition thereon a chromium plated layer of 40 μm thickness (second layer). Within 1 h from formation of the first and second layers, their surfaces were subjected to a treatment against hydrogen embrittlement by heating them at 190° C. to 230° C. for longer than 3 h.

Example 3

Under plating conditions similar to those used in Example 1, a chromium plated layer of 30 μm thickness (first layer) was deposited, followed by deposition thereon a chromium plated layer of 70 μm thickness (second layer).

Example 4

Within 1 h from formation of the first and second layers of Example 3, their surfaces were subjected to a treatment against hydrogen embrittlement by heating them at 190° C. to 230° C. for longer than 3 h.

Example 5 to Example 6

The rotor and stator were surface treated under the conditions shown in Table 1 below.

Comparative Example 1

The rotor and stator in the mechanical pulverizing apparatus shown in FIGS. 5A and 5B were not subjected to surface treatment.

Comparative Example 2

Chromium plating treatment without the addition of Mg, Al, Si, Ti, Mn, Fe, and C elements was performed under the following plating conditions on the surface of the rotor and stator.

[Plating Conditions]

Bath temperature: about 60° C.; pH: strongly acidic (pH 3 or less); electric current: depends on volume, weight, and surface area; voltage; depends on volume, weight, and surface area; time depends on volume, weight, and surface area (deposition rate: 7 μm to 10 μm/Hr); stirring: no stirring.

Surface treatment conditions for the rotor and stator in Examples 1 to 6 and Comparative Examples 1 to 2 and properties of the chromium plated layers obtained are shown in Table 1.

The adhesive force of the chromium plated layer was measured in a tensile test of metallic specimens fir tensile test, prepared in accordance with ISO6892 (JIS Z2201 (JIS No. 5 specimen).

The hardness of the outermost surface layer of the chromium plated layer was found by a Vickers hardness test. Wear state of the rotor and stator surface after the pulverizing treatment was checked visually and by touch, the surface state of the rotor and stator was observed using an electron microscope with a magnification of 25 or greater, and evaluation was performed based on the following evaluation criteria. The results are shown in Table 2.

[Evaluation Criteria]

A: surface of the rotor and stator was not worn.

B: very small scratches and chips were observed on the surface of the rotor and stator.

C: very small cracks were observed on the surface of the rotor and stator.

D: wear of the surface of the rotor and stator was significant and a large number of scratches and chips were observed.

TABLE 1

| | Example 1 | Example 2 | Example 3 | Example 4 | Example 5 | Example 6 | Comparative Example 1 | Comparative Example 2 |
|---|---|---|---|---|---|---|---|---|
| Treatment against hydrogen embrittlement | Absent | Present | Absent | Present | Absent | Present | Absent | Absent |
| Layer configuration | One layer | Two layers | Two layers | Two layers | Two layers | Two layers | — | One layer |
| Thickness of first layer (μm) | 40 | 10 | 30 | 30 | 50 | 50 | — | 30 |

TABLE 1-continued

| | Example 1 | Example 2 | Example 3 | Example 4 | Example 5 | Example 6 | Comparative Example 1 | Comparative Example 2 |
|---|---|---|---|---|---|---|---|---|
| Thickness of second layer (μm) | — | 40 | 70 | 70 | 100 | 100 | — | — |
| Adhesive force of first layer (t/cm$^2$) | 1.5 | 0.5 | 1.5 | 1.5 | 2.5 | 2.5 | — | 1.5 |
| Adhesive force of second layer (t/cm$^2$) | — | 0.5 | 1.5 | 1.5 | 2.5 | 2.5 | — | — |
| Surface hardness of outermost surface layer (HV) | 800 | 1,000 | 1,400 | 1,000 | 1,200 | 1,000 | 600 | 800 |

TABLE 2

| | Example 1 | Example 2 | Example 3 | Example 4 | Example 5 | Example 6 | Comparative Example 1 | Comparative Example 2 |
|---|---|---|---|---|---|---|---|---|
| Wear state of rotor and stator after operation | Microcracks appear on surface | Wear is present on surface (scratches, chips) | Microcracks appear on surface | No wear on surface | Microcracks appear on surface | No wear on surface | Significant wear is present on surface (scratches, chips) | Significant wear is present on surface (scratches, chips) |
| Observation results under electron microscope (Observed under magnification of 25 or greater) | C | B | C | A | C | A | D | D |

INDUSTRIAL APPLICABILITY

The electrophotographic toner pulverizing apparatus and electrophotographic toner pulverizing method can be used advantageously for pulverizing toners for use in image formation by an electrophotographic method.

The invention claimed is:

1. An electrophotographic toner pulverizing apparatus comprising:

a pulverizing chamber having at least a rotor and a stator disposed therein, wherein a surface of at least one of the rotor and the stator has a chromium plated layer having Cr as a main component and containing Mg, Al, Si, Ti, Mn, Fe, and C elements, and the chromium plated layer includes two or more layers, and the two or more layers include a first layer positioned on a side of the surface of at least one of the rotor and the stator and a second layer positioned on the first layer.

2. The electrophotographic toner pulverizing apparatus according to claim 1, wherein the surface the chromium plated layer is subjected to a treatment against hydrogen embrittlement.

3. The electrophotographic toner pulverizing apparatus according to claim 1, wherein a thickness of the first layer is 10 μm to 50 μm.

4. The electrophotographic toner pulverizing apparatus according to claim 1, wherein a total thickness of the second layer and layers subsequent to the second layer is 40 μm to 100 μm.

5. The electrophotographic toner pulverizing apparatus according to claim 1, wherein an adhesive force between the first layer and a plating object is 0.5 t/cm$^2$ to 2.5 t/cm$^2$.

6. The electrophotographic toner pulverizing apparatus according to claim 1, wherein an adhesive force between the second layer and layers subsequent to the second layer, and a plating object is 0.5 t/cm$^2$ to 2.5 t/cm$^2$.

7. The electrophotographic toner pulverizing apparatus according to claim 1, wherein a surface hardness of an outermost surface in the chromium plated layer is HV800 to HV1,400, as a Vickers hardness.

* * * * *